US005645751A

United States Patent [19]

Haley

[11] Patent Number: 5,645,751

[45] Date of Patent: Jul. 8, 1997

[54] FABRIC FINISHING STIFFENING COMPOSITION

[75] Inventor: Kalliopi S. Haley, Byron Center, Mich.

[73] Assignee: Amway Corporation, Ada, Mich.

[21] Appl. No.: 379,095

[22] Filed: Jan. 26, 1995

Related U.S. Application Data

[63] Continuation of Ser. No. 114,069, Sep. 2, 1993, abandoned, which is a continuation-in-part of Ser. No. 950,118, Sep. 23, 1992, abandoned.

[51] Int. Cl.[6] ..... D06M 15/643; D06M 15/333; D06M 15/19

[52] U.S. Cl. ..... 252/8.91; 252/8.83; 510/513; 510/515; 510/516; 510/517; 510/522; 510/527; 510/528; 510/475; 510/466; 510/504

[58] Field of Search ..... 252/8.6, 8.9, 174.23, 252/174.15, 8.91, 8.83; 510/513, 515, 516, 517, 522, 527, 528, 475, 466, 504

[56] References Cited

U.S. PATENT DOCUMENTS

| | | | |
|---|---|---|---|
| 2,491,642 | 12/1949 | Brant | 260/29.6 |
| 2,500,144 | 3/1950 | Beck | 260/17 |
| 2,663,989 | 12/1953 | Schlatter et al. | 57/153 |
| 2,755,198 | 7/1956 | Stewart | 117/10 |
| 2,808,380 | 10/1957 | Olsen et al. | 260/17.4 |
| 2,993,872 | 7/1961 | Gagnon | 260/8 |
| 3,087,920 | 4/1963 | Suzumura et al. | 260/91.3 |
| 3,210,208 | 10/1965 | Grass, Jr. et al. | 106/148 |
| 3,316,190 | 4/1967 | Suzumura et al. | 260/17.4 |
| 3,634,295 | 1/1972 | Dunlap et al. | 260/29.6 WB |
| 3,639,309 | 2/1972 | Starkman | 260/9 |
| 3,738,957 | 6/1973 | Iler | 260/41 A |
| 3,770,471 | 11/1973 | Katsumi et al. | 106/197 C |
| 3,773,776 | 11/1973 | Iler | 260/29.6 |
| 3,804,785 | 4/1974 | Hijiya et al. | 260/17.4 |
| 3,833,393 | 9/1974 | Kandathil | 106/212 |
| 3,896,033 | 7/1975 | Grimm, III | 252/8.8 |
| 4,179,382 | 12/1979 | Rudkin et al. | 252/8.8 |
| 4,179,426 | 12/1979 | Steinbach et al. | 260/29.2 M |
| 4,222,922 | 9/1980 | Rees | 260/29.6 BE |
| 4,251,403 | 2/1981 | Rees | 260/17.45 G |
| 4,309,510 | 1/1982 | Kleber | 525/6 |
| 4,314,805 | 2/1982 | McKnight | 8/137 |
| 4,383,063 | 5/1983 | Rees | 524/91 |
| 4,390,591 | 6/1983 | Marshall et al. | 428/391 |
| 4,399,245 | 8/1983 | Kleber et al. | 524/108 |
| 4,399,247 | 8/1983 | Ona et al. | 524/204 |
| 4,401,836 | 8/1983 | Engelhardt et al. | 525/61 |
| 4,495,226 | 1/1985 | Smith | 427/326 |
| 4,552,564 | 11/1985 | DeBoer et al. | 8/115.6 |
| 4,557,854 | 12/1985 | Plueddemann | 252/174.15 |
| 4,582,874 | 4/1986 | Grape et al. | 524/588 |
| 4,600,735 | 7/1986 | Larsson et al. | 523/216 |
| 4,620,878 | 11/1986 | Gee | 106/287.15 |
| 4,624,889 | 11/1986 | Bries | 428/264 |
| 4,640,946 | 2/1987 | Vassallo et al. | 524/45 |
| 4,780,499 | 10/1988 | Villarreal et al. | 524/549 |
| 4,784,665 | 11/1988 | Ona et al. | 8/115.6 |
| 4,797,127 | 1/1989 | Marten et al. | 8/115.6 |
| 4,797,964 | 1/1989 | Ritter et al. | 8/115.6 |
| 4,835,198 | 5/1989 | Kohno et al. | 524/47 |
| 4,844,709 | 7/1989 | Marten | 8/115.6 |
| 4,845,140 | 7/1989 | Marten | 524/245 |
| 4,857,212 | 8/1989 | Ona et al. | 252/8.6 |
| 4,923,623 | 5/1990 | Coffindaffer | 252/8.8 |
| 4,940,743 | 7/1990 | Grape et al. | 524/377 |
| 4,950,412 | 8/1990 | Duffin et al. | 252/8.6 |
| 4,964,873 | 10/1990 | Duffin et al. | 8/137 |
| 4,973,643 | 11/1990 | O'Lenick, Jr. | 528/15 |
| 5,017,297 | 5/1991 | Spyropolos et al. | 252/8.8 |
| 5,062,971 | 11/1991 | Coffindaffer et al. | 252/8.6 |
| 5,064,543 | 11/1991 | Coffindaffer et al. | 252/8.6 |
| 5,070,168 | 12/1991 | O'Lenick, Jr. | 528/10 |
| 5,073,275 | 12/1991 | Ona et al. | 252/8.6 |
| 5,077,040 | 12/1991 | Bergmann et al. | 424/70 |
| 5,080,687 | 1/1992 | Langer et al. | 8/115.6 |
| 5,136,063 | 8/1992 | O'Lenick, Jr. | 554/77 |
| 5,152,924 | 10/1992 | Gee | 252/312 |
| 5,180,843 | 1/1993 | O'Lenick, Jr. | 556/77 |
| 5,207,933 | 5/1993 | Trinh et al. | 252/8.6 |
| 5,226,923 | 7/1993 | O'Lenick, Jr. | 8/115.6 |
| 5,232,611 | 8/1993 | Ohashi et al. | 252/8.6 |
| 5,254,268 | 10/1993 | Schwartz | 252/8.6 |

FOREIGN PATENT DOCUMENTS

| | | |
|---|---|---|
| 38-17093 | 9/1963 | Japan . |

*Primary Examiner*—Michael Tierney
*Attorney, Agent, or Firm*—G. Peter Nichols; Brinks Hofer Gilson & Lione

[57] ABSTRACT

A ready-to-use fabric composition and a fabric finish concentrate composition are disclosed as well as a method of providing a stiffness to a fabric. The compositions comprise water, a water soluble polymer that casts a clear, continuous film from aqueous solution and a film-compatible silicone ironing aid/lubricant that in combination dries on clothes or textiles as a colorless and transparent, flexible film. Optionally, a preservative and, in some instances other ingredients such as fragrances and dyes may be added for aesthetic purposes.

12 Claims, No Drawings

FABRIC FINISHING STIFFENING COMPOSITION

This application is a continuation of application Ser. No. 08/114,069, filed Sep. 21, 1993, now abandoned.

BACKGROUND OF THE INVENTION

The present invention relates to the field of fabric finish compositions, more particularly the present invention relates to the field of compositions used on fabrics to provide a fabric with body or stiffness and a method of providing body or stiffness to a fabric. The composition may be used during ironing as a spray, in the rinse cycle of a washing machine, or in a laundry tub. It is well-known in the related art to use liquid starch containing compositions for application to individual textiles for wrinkle reduction and shape retention. It is also well-known in the related art to use compositions consisting of polyvinyl alcohols, starch or other polymers for the purpose of sizing textile materials. It is also common to use silicones in fabric finish products as lubricants to aid in ironing ease.

Generally, various limitations have been encountered in the related art in formulating a clothing or textile stiffening composition. One of the limitations of related art compositions is that the majority of these compositions, when dried, tend to leave a white, often crystalline, residue on the fabric which may flake off of the fabric either during ironing or at a later time. A further limitation is that the above-mentioned compositions of the relevant related art tend to discolor clothing and textiles due to the opaque white color of their residue when dried on fabrics. Further, due to its nature, starch-containing compositions may also turn yellow or brown when ironed due to excessive iron heat and scorching of the starch.

Relevant related art teaches a soil repellant coating composition comprising silica, polyvinyl alcohol and a wetting agent in an aqueous carrier medium. The anti-soil repellant composition can be applied to textiles, such as fabrics for clothes.

Other relevant related art discloses aqueous solutions of polyvinyl alcohol and silica, such as colloidal silica, which may be employed as coatings.

Another area of related art teaches textile sizing compositions comprising hydrolyzed polyvinyl alcohol as well as art which discloses starch and polyvinyl alcohol compositions as textile sizes.

An additional area of related art teaches textile treating compositions comprising silicone emulsions.

SUMMARY OF THE INVENTION

Briefly stated, I have discovered that these and other problems in the art can be solved by providing aqueous compositions containing selected water soluble polymers and silicone ironing aid/lubricants which, when used in combination, have the surprising result of drying on clothes and textiles as a colorless, transparent and flexible film. Heretofore, it has not been known in the art that it was possible to prepare these silicone-containing fabric finishes that dry to clear, colorless and flexible films. This has been due to the use of either stiffening agents that are not capable of drying to clear films (such as starches, modified starches, etc.) and/or to the use of silicones that would corrupt otherwise clear film systems (e.g., common silicone macroemulsions). I have found that by the correct choice of a water soluble, film-forming polymer and a compatible silicone ironing aid/lubricant, compositions can be prepared that cast continuous, clear and flexible films (i.e., films which have the property of appearing like a clear plastic sheet, similar to food wrap products). The silicone ironing aid/lubricant can be any silicone composition that acts as a lubricant for an iron and, in combination with a water soluble polymer, dries on clothes or textiles as a colorless and transparent, flexible film. It has been found that certain silicone emulsions, preferably microemulsions with a particle size up to 0.1 micron, and self-emulsifying waxes are preferred. It is of further surprise that a correct combination of a silicone ironing aid/lubricant and a polymer cannot be easily predicted by their properties alone or even the appearance of the liquid composition itself. Many polymers give fairly clear solutions in water but do not yield clear films on drying. Many silicones, on the other hand, are water soluble but turn cloudy in solution when used with polymers in aqueous form or, more surprising yet, can give crystal clear solutions in combination with the polymer but ultimately dry to give cloudy, unacceptable films.

The composition of the present invention is provided as either a ready-to-use fabric finish composition or a fabric finish concentrate composition which can be diluted by the user in ratios such as 1:1, 1:3, 1:5, 1:7 and other ratios as the user may choose for stiffness purposes. The concentrated composition can also be used without dilution if added to a tub of water or during the rinse cycle of a washing machine. In one embodiment, the ready-to-use fabric finish composition of the present invention includes between about 0.1 and about 8% by weight of a water soluble polymer capable of casting a clear, continuous film from aqueous solution, between about 0.001 and about 3% by weight of a film-compatible silicone ironing aid/lubricant (i.e., the silicone is incorporated into the polymer film and upon drying, said film remains clear), between about 0.05 and about 1% by weight of a preservative and the balance of either hard or soft water in a range of between about 99.9% and about 88% by weight. The composition may also include deminimus amounts of various other materials and additives such as fragrances, dyes and anti-corrosive agents.

According to another embodiment of the present invention, the composition comprises a fabric finish concentrate which can be diluted by the user to a preferred strength or used as is. The fabric finish concentrate composition includes between about 1 and about 35% by weight of a water soluble polymer which casts a clear, continuous film from aqueous solution, between about 0.2 and about 8% by weight of a select film-compatible silicone ironing aid/lubricant, between about 0.05 and about 1% by weight of a preservative and the balance comprising hard or soft water in the range of between about 98.75% and about 56% by weight. The composition may also include deminimus quantities of various other materials and additives such as fragrances, dyes and anti-corrosive agents.

One of the advantages in either the ready-to-use or concentrated fabric finish embodiments of the composition of the present invention is that combining certain water soluble polymers with a film-compatible silicone ironing aid/lubricant has the surprising result in that the composition dries on clothes and textiles as an almost colorless, transparent and flexible film. The advantage of using the composition of the present invention on clothing or textiles is that because of the clear, water soluble nature of the film end product, the composition does not change the color of the fabric and will not build up over time on the fabric. Also, the film end product of the composition will not flake off of the fabric because it dries as a clear, continuous film as compared to the crystalline-type residue left by many related art compositions. A further advantage to the composition is that the use of the silicone ironing aid/lubricant gives lubricity to the composition so that when used in ironing clothing or textiles, the iron glides easier on the fabric than would be the case if just a stiffening agent such as polyvinyl alcohol was used alone on the fabric. An additional advantage of the present invention is that the composition keeps the iron from sticking to the fabric and, thereafter, potentially burning or scorching the fabric. Further, other compositions which use a water soluble polymer such as polyvinyl alcohol in combination with common silicone ironing aid/lubricants have a tendency to turn any residue of the composition opaque, which defeats the purpose of using a clear stiffening agent such as polyvinyl alcohol. An additional advantage in using the composition of the present invention on clothing is that the typical starch-type product, when applied to clothing which is being ironed or pressed, changes to a yellowish/brownish color when it starts to burn. In contrast, the composition of the present invention does not turn a color because it will not burn or scorch on the fabric. Additionally, the composition of the present invention upon application gives a smooth feel to the fabric.

It is noted that unless otherwise indicated, the percentages as stated in the specification and the appended claims are intended to refer to percentages by weight of the total composition.

The present invention, together with attendant objects and advantages, will be best understood with reference to the detailed description below.

DETAILED DESCRIPTION OF THE PREFERRED EMBODIMENTS

As mentioned above, the fabric finish composition of the present invention is an aqueous product comprising a water soluble polymer that casts a clear, continuous film from aqueous solution and a film-compatible silicone ironing aid/lubricant, that in combination dries on clothes or textiles as a colorless and transparent, flexible film. Optionally, a preservative and, in some instances, a fragrance as well as other additives and materials such as dyes and anti-corrosive agents may also be used.

As indicated above, one embodiment of the composition of the present invention comprises a ready-to-use fabric finish composition and another embodiment comprises a fabric finish concentrate composition which can be diluted by the user to the user's preference.

In a preferred embodiment of the ready-to-use fabric finish composition, the composition comprises up to about 8% by weight of a water soluble polymer that casts a clear, continuous film from aqueous solution, preferably in a range of between about 0.1 and about 8% by weight, more preferably in a range of between about 0.5 and about 7% by weight and most preferably in a range of between about 0.75 and about 4% by weight. The composition further comprises a film-compatible silicone ironing aid/lubricant up to about 3% by weight, preferably in a range of between about 0.001 and about 3% by weight, more preferably in a range of between about 0.075 and about 2% by weight and most preferably in a range of between about 0.1 and 1% by weight. The balance of the composition comprises water in the range of between about 99.9 and about 88% by weight, more preferably in the range of between about 99.38 and about 90% by weight and most preferably in the range of between about 99.1 and about 94% by weight. In another preferred embodiment the composition further comprises between about 0.05 and about 1% of a preservative and most preferably 0.10% by weight. The silicone ironing aid/lubricant can be any silicone composition and the water soluble polymer can be any polymer, which when the two ingredients are used in combination, dries on clothes and textiles as a colorless and transparent, flexible film.

In accordance with a preferred embodiment of the fabric finish concentrate composition, the composition comprises up to 35% by weight of a water soluble polymer that casts a clear, continuous film from aqueous solution, preferably in a range of between about 1 and 35% by weight, more preferably in a range of between about 1.5 and about 25% by weight and most preferably in a range of between about 2 and about 20% by weight. The film-compatible silicone ironing aid/lubricant is contained in the composition up to 8% by weight, preferably in a range of between about 0.2 and about 8% by weight, more preferably in a range of between about 0.35 and about 7% by weight and most preferably in a range of between about 0.5 and about 5% by weight. The balance of the composition comprises water in the range of between about 98.8 and about 56% by weight, more preferably in the range of between about 98.1 and about 67% by weight and most preferably in the range of between about 97.5 and about 74% by weight. In another preferred embodiment the composition further comprises between about 0.05 and about 1% of a preservative and most preferably 0.10% by weight. The silicone ironing aid/lubricant can be any silicone composition and the water soluble polymer can be any polymer, which when the two ingredients are used in combination dries on clothes and textiles as a colorless and transparent, flexible film.

In either the ready-to-use fabric finish embodiment or the concentrate fabric finish embodiment of the composition of the present invention, in order to determine which combinations of water soluble polymers and silicone ironing aid/lubricants can be used to form a transparent and colorless flexible film when dried on clothing and textiles, testing and evaluation are conducted by combining any of a variety of a water soluble polymer and a silicone ironing aid/lubricant in the amounts set forth above, placing 10–20 g of the composition on an aluminum tray and drying the composition on an Ohaus moisture determination balance. The resulting film is visually evaluated for clarity. Alternatively, films can be similarly cast on dark plastic dishes or black glass or ceramic surfaces. Additionally, the same methodology can be used to determine which water soluble polymers cast a clear, continuous film from aqueous solution.

In either of the ready-to-use or concentrate fabric finish embodiments of the composition of the present invention, the silicone ironing aid/lubricant is selected from the group consisting of silicone emulsions, water dispersible silicone waxes and mixtures thereof and preferably comprises a silicone emulsion with a particle size of up to about 0.1 micron, most preferably between about 0.05 and about 0.1 micron. In one preferred embodiment the silicone emulsion comprises an amino-functional polydimethylsiloxane or an emulsion comprising polymerized dimethyl, methyl silicone resin from cyclic siloxanes. A silicone emulsion shown to produce the surprising result of drying to a colorless, flexible film when used in combination with the selected water soluble polymer described below includes an amino-functional polydimethylsiloxane marketed under the trade name SILICONE EMULSION VP-1495 E and produced by Wacker Silicones Corporation. This amino-functional polydimethylsiloxane comprises 3((2 amino ethyl) amino) propylmethyl, dimethyl siloxanes and silicones (CAS #71750-79-3) and fatty alcohol polyglycol ether (CAS

#9043-30-5). Another silicone emulsion useful in the present invention includes a silicone emulsion prepared by DOW CORNING® Corporation and sold under the trade name DOW CORNING 1716, which composition comprises 5% $C_{11-15}$ ethoxylated secondary alcohol, 3% quaternary ammonium compound, 28% dimethyl, methyl silicone resin and 61% water and is more specifically set forth in detail in U.S. Pat. No. 5,152,924 and U.S. patent application Ser. No. 07/532,471, both of which are incorporated herein by reference.

The silicone ironing aid/lubricant used in either the ready-to-use or concentrate fabric finish embodiments of the composition of the present invention is more preferably a silicone microemulsion with a particle size up to 0.1 micron and most preferably is the silicone microemulsion sold under the trade name DOW CORNING 1716.

In another preferred embodiment of the ready-to-use or concentrate fabric finish composition of the present invention, the silicone ironing aid/lubricant comprises a water dispersible silicone wax. Most preferably the silicone wax used is marketed under the trade name SILWAX WD-IS produced by Siltech Inc. SILWAX WD-IS is a liquid silicone wax comprising dimethicone copolyol isostearate, and is more fully described in U.S. Pat. Nos. 5,226,923, 5,180,843, 5,136,063 and 5,070,168 which are herein incorporated by reference.

In either the ready-to-use or concentrate fabric finish composition embodiments, it is preferred that the water soluble polymer be selected from the group consisting of polyvinyl alcohol, hydroxyethyl cellulose, polymers and copolymers of acrylates and methacrylates and salts thereof and mixtures thereof, with polyvinyl alcohol being most preferred. The polyvinyl alcohol which is preferred comprises a molecular weight of about 10,000–200,000, more preferably in the range of about 11,000–186,000 and most preferably in the range of about 12,000–150,000. The PVA further comprises a pH of a 4% aqueous solution in the preferred range of between 2–11, more preferably in the range of between 3–9 and most preferably in the range of between 4–8 and the PVA has a viscosity of a 4% aqueous solution in the preferred range of between 2–80 cps, more preferably in the range of between 2–70 cps and most preferably in the range of between 3–65 cps. Additionally, the PVA further comprises a percent hydrolysis in the preferred range of between 30–100%, more preferably in the range of between 86–99% and most preferably in the range of between 86–98%, with any particle size being usable.

In the most preferred embodiment of the ready-to-use fabric finish composition of the present invention, the composition comprises 96.97% by weight of water; 2.5% by weight of polyvinyl alcohol which has a molecular weight of between 31,000–50,000, a pH of a 4% aqueous solution of between 4.5–6.5, a viscosity of a 4% aqueous solution of between 5–6 cps, a percent hydrolysis of between 87–90%; 0.38% by weight of the silicone microemulsion with particle size of between 0.05–0.1 micron which is sold by DOW CORNING® Corporation under the trade name DOW CORNING 1716 and 0.10% by weight of a preservative which is a mixture of two isothiazolinones and is commercially sold by Rohm & Hass Co. under the trade name KATHON CG and 0.05% of a fragrance commercially sold by Givaudan-Roure Corp. under the trade name GIVAUDAN ROURE Y-4234.

In the most preferred embodiment of the fabric finish concentrate composition of the present invention, the composition comprises 88.35% by weight of water; 10% by weight of polyvinyl alcohol with a molecular weight of between 31,000–50,000, a pH of a 4% aqueous solution of between 4.5–6.5, a viscosity of a 4% aqueous solution of between 5–6 cps, a percent hydrolysis of between 87–90%; 1.5% by weight of a silicone microemulsion with a particle size of between 0.05–0.1 micron which is sold by DOW CORNING® Corporation under the trade name DOW CORNING 1716 and 0.10% by weight of a preservative which is a mixture of two isothiazolinones and is commercially sold by Rohm & Hass Co. under the trade name KATHON CG and 0.05% by weight of a fragrance sold by Givaudan-Roure Corp. under the trade name GIVAUDAN ROURE Y-4234.

To provide a better understanding of the invention, Examples A–J on Table I of the ready-to-use fabric finish embodiment of the present invention and Examples K–T on Table II of the fabric finish concentrate embodiment of the present invention are given as an illustration and with no limitative nature whatsoever. Example A represents the most preferred embodiment of the ready-to-use embodiment of the present composition and Example K represents the most preferred embodiment of the fabric finish concentrate embodiment of the present composition. Further, Examples 1–10 on Tables IIIa and IIIb are given of commercial products and combinations of silicone ironing aid/lubricants and water soluble polymers which did not produce the surprising results found by this invention of drying to a clear, transparent and flexible film.

TABLE I

| | READY-TO-USE FORM | | | | | | | | | |
|---|---|---|---|---|---|---|---|---|---|---|
| | A | B | C | D | E | F | G | H | I | J |
| Water | 96.97 | 87.85 | 90.35 | 94.40 | 99.799 | 99.325 | 99.05 | 97.02 | Balance equal to 100% | 96.97 |
| PVA | 2.50 | 8.00 | 7.00 | 4.00 | 0.100 | 0.500 | 0.75 | 2.50 | 3.00 | — |
| Microemulsion | 0.38 | 3.00 | 2.00 | 1.00 | 0.001 | 0.075 | 0.10 | 0.38 | 0.30 | 0.38 |
| Preservative | 0.10 | 1.00 | 0.50 | 0.50 | 0.050 | 0.05 | 0.05 | 0.10 | 0.10 | 0.10 |
| Fragrance | 0.05 | 0.15 | 0.15 | 0.10 | 0.050 | 0.05 | 0.05 | — | 0.05 | 0.05 |
| Hydroxyethyl Cellulose | — | — | — | — | — | — | — | — | — | 2.50 |

TABLE II

| | CONCENTRATE FORM | | | | | | | | | |
|---|---|---|---|---|---|---|---|---|---|---|
| | K | L | M | N | O | P | Q | R | S | T |
| Water | 88.35 | 88.40 | 55.85 | 67.5 | 74.50 | 98.65 | 98.05 | 97.40 | Balance equal to 100% | 94.00 |
| PVA | 10.00 | 10.00 | 35.00 | 25.00 | 20.00 | 1.00 | 1.50 | 2.00 | 13.00 | — |
| Microemulsion | 1.50 | 1.50 | 8.00 | 7.00 | 5.00 | 0.20 | 0.35 | 0.50 | 1.10 | 0.85 |
| Preservative | 0.10 | 0.10 | 1.00 | 0.50 | 0.50 | 0.05 | 0.10 | 0.10 | 0.10 | 0.10 |
| Fragrance | 0.05 | — | 0.15 | — | — | 0.10 | — | — | 0.05 | 0.05 |
| Hydroxyethyl Cellulose | — | — | — | — | — | — | — | — | — | 5.00 |

TABLE IIIa

| Formula | Composition of the Present Invention | 1 | 2 | 3 | 4 | 5 |
|---|---|---|---|---|---|---|
| Water | 88.35 | 88.35 | 88.35 | 88.35 | 88.35 | 88.35 |
| PVA | 10.00 | 10.00 | 10.00 | 10.00 | 10.00 | — |
| Modified Starch (AMAIZO 895) | — | — | — | — | — | 10.00 |
| Anionic Emulsified Polydimethylsiloxane (DOW CORNING HV-490) | — | 1.50 | — | — | — | — |
| Polymerized Cyclic Siloxane (DOW CORNING 1716) | 1.50 | — | — | — | — | 1.50 |
| Copolymer Surfactant; Nonionic Polyalkylene Oxide Modified Dimethylpolyoloxane (SILWET L-7200) | — | — | 1.50 | — | — | — |
| Copolymer Surfactant; Nonionic Polyalkylene Oxide Modified Dimethylpolyoloxane (SILWET L-7622) | — | — | — | 1.50 | — | — |
| Emulsion of Polydimethylsiloxane (UNION CARBIDE LE-467) | — | — | — | — | 1.50 | — |
| Preservative | .10 | .10 | .10 | .10 | .10 | .10 |
| Fragrance | .05 | .05 | .05 | .05 | .05 | .05 |
| Appearance of Solution | slightly hazy, transparent | cloudy | clear | cloudy | cloudy | cloudy |
| Appearance of Dried Solids | transparent, colorless, flexible film | cloudy film | cloudy film | cloudy film | cloudy film | cloudy, crystalline |

TABLE IIIb

| Formula | 6 Commercial Starch A | 7 Commercial Sizing B | 8 Commercial Starch C | 9 Commercial Starch D | 10 Commercial Starch E |
|---|---|---|---|---|---|
| Water | | | | | |
| PVA | | | | | |
| Modified Starch (AMAIZO 895) | | | | | |
| Anionic Emulsified Polydimethylsiloxane (DOW CORNING HV-490) | | | | | |
| Polymerized Cyclic Siloxane (DOW CORNING 1716) | | | | | |
| Copolymer Surfactant; Nonionic Polyalkylene Oxide Modified Dimethylpolyoloxane (SILWET L-7200) | | | | | |
| Copolymer Surfactant; Nonionic Polyalkylene Oxide Modified Dimethylpolyoloxane (SILWET L-7622) | | | | | |
| Emulsion of Polydimethylsiloxane (UNION CARBIDE LE-467) | | | | | |

TABLE IIIb-continued

| Formula | 6 Commercial Starch A | 7 Commercial Sizing B | 8 Commercial Starch C | 9 Commercial Starch D | 10 Commercial Starch E |
|---|---|---|---|---|---|
| Preservative | | | | | |
| Fragrance | | | | | |
| Appearance in Solution | aerosol | aerosol | clear | aerosol | aerosol |
| Appearance of Dried Solids | white crystalline | white flexible film | whitish film | yellowish crystalline | white broken film |

The embodiments of the invention in which an exclusive property or privilege is claimed are defined as follows:

1. A ready-to-use fabric finish composition consisting essentially of:

a) a water soluble polymer that casts a clear, continuous film from aqueous solution selected from the group consisting of polyvinyl alcohol, polymers and copolymers of acrylates and methacrylates and salts thereof present at a level of up to about 8%;

b) a film-compatible silicone ironing aid/lubricant selected from the group consisting of a polydimethylsiloxane microemulsion containing a quaternary ammonium compound, an amino-functional polydimethylsiloxane, a dimethicone copolyol isostearate and mixtures thereof having a particle size ranging up to 0.1 micron and present at a level of up to about 3%; and, c) water, wherein the composition, when dried, forms a colorless and transparent, flexible film.

2. The ready-to-use fabric finish composition of claim 1 wherein said water soluble polymer is polyvinyl alcohol.

3. The ready-to-use fabric finish composition of claim 2 wherein said polyvinyl alcohol comprises 2.5% by weight of the total composition.

4. A fabric finish concentrate composition consisting essentially of:

a) a water soluble polymer that casts a clear, continuous film from aqueous solution wherein the water soluble polymer is selected from the group consisting of polyvinyl alcohol, polymers and copolymers of acrylates and methacrylates and salts thereof present at a level of up to about 35%;

b) a film-compatible silicone ironing aid/lubricant selected from the group consisting of a polydimethylsiloxane microemulsion containing a quaternary ammonium compound, an amino-functional polydimethylsiloxane, a dimethicone copolyol isostearate and mixtures thereof having a particle size ranging up to 0.1 micron and present at a level of up to about 8%; and, c) water, wherein the composition, when dried, forms a colorless and transparent, flexible film.

5. The fabric finish concentrate composition of claim 4 wherein said water soluble polymer is polyvinyl alcohol.

6. The fabric finish concentrate composition of claim 5 wherein said polyvinyl alcohol comprises 10% by weight of the total composition.

7. The fabric finish concentrate composition of claim 4 further consisting essentially of 0.10% by weight of a preservative.

8. A fabric finish concentrate composition consisting essentially of:

a) from about 1 to about 35% by weight of a water soluble polymer that casts a clear, continuous film from aqueous solution wherein said water soluble polymer is polyvinyl alcohol;

b) from about 0.2 to about 8% by weight of a film-compatible silicone ironing aid/lubricant wherein said film-compatible silicone ironing aid/lubricant is selected from the group consisting of a polydimethylsiloxane microemulsion containing a quaternary ammonium compound, an amino-functional polydimethylsiloxane and mixtures thereof having a particle size ranging up to 0.1 micron; and, c) water, wherein the composition, when dried, forms a colorless and transparent, flexible film.

9. The fabric finish concentrate composition of claim 8 wherein said polyvinyl alcohol has a molecular weight in range of 10,000–200,000, a pH of a 4% aqueous solution in the range of 2–11, a viscosity of a 4% aqueous solution in the range of 2–80 cps, and a percent hydrolysis in the range of 30–100%.

10. A ready-to-use fabric finish composition consisting essentially of:

a) from about 1 to about 8% by weight of a water soluble polymer which casts a clear film from aqueous solution, wherein the water soluble polymer is polyvinyl alcohol;

b) from about 0.001 to about 3% of a film-compatible silicone ironing aid/lubricant wherein said film-compatible silicone ironing aid/lubricant is selected from the group consisting of a polydimethylsiloxane microemulsion containing a quaternary ammonium compound, an amino-functional polydimethylsiloxane and mixtures thereof having a particle size ranging up to 0.1 micron; and, c) water, wherein the composition, when dried, forms a colorless and transparent, flexible film.

11. The fabric finish concentrate composition of claim 10 wherein said polyvinyl alcohol has a molecular weight in range of 10,000–200,000, a pH of a 4% aqueous solution in the range of 2–11, a viscosity of a 4% aqueous solution in the range of 2–80 cps, and a percent hydrolysis in the range of 30–100%.

12. A fabric finish concentrate composition consisting essentially of:

a) 88.35% by weight of water;

b) 10% by weight of polyvinyl alcohol with a molecular weight of between 31,000 and 50,000, a pH of a 4% aqueous solution of between 4.5 and 6.5, a viscosity of a 4% aqueous solution of between 5–6 cps, a percent hydrolysis of between 87 and 90%;

c) 1.5% by weight of a polydimethylsiloxane microemulsion containing a quaternary ammonium compound with a particle size of between 0.05 and 0.1 micron;

d) 0.10% of a preservative; and, e) 0.05% of a fragrance, wherein the composition, when dried, forms a colorless and transparent, flexible film.

* * * * *